US005539371A

United States Patent [19]

Yu

[11] Patent Number: 5,539,371

[45] Date of Patent: Jul. 23, 1996

[54] FUSELESS BREAKING SWITCH

[76] Inventor: Tsung-Mou Yu, No. 4, Alley 2, Lane 23, Sec. 3, Pa-Te Road, Pan-Chiao City, Taipei Hsien, Taiwan

[21] Appl. No.: 525,051

[22] Filed: Sep. 8, 1995

[51] Int. Cl.[6] ..... H01H 71/16; H01H 71/04

[52] U.S. Cl. ..... 337/66; 337/76; 337/67; 337/79

[58] Field of Search ..... 337/66, 76, 53, 337/67, 68, 69, 74, 75, 140, 67

[56] References Cited

U.S. PATENT DOCUMENTS 3,846,729 11/1974 Sorimachi ..... 337/343

5,004,994 4/1991 Korczynski ..... 337/66

5,223,813 6/1993 Cambreleng ..... 337/66

5,262,748 11/1993 Yu ..... 337/66

*Primary Examiner*—Leo P. Picard

*Assistant Examiner*—Stephen T. Ryan

*Attorney, Agent, or Firm*—Pro-Techtor International

[57] ABSTRACT

A fuseless breaking switch comprises essentially a casing, an alloy blade, first, second, and the third conductive plate, a spring blade and an adjusting screw. The switching on (off) of the button allows a closed (open) circuit through the alloy blade and the conductive plates and an adjusting screw secured inside the casing will help ensure the sensitivity of dealing with different voltage loading through the adjusting to the curvature of the alloy blade by the adjusting screw.

3 Claims, 7 Drawing Sheets

FUSELESS BREAKING SWITCH

FIELD OF THE PRESENT INVENTION

The present invention relates generally to circuit breakers, and more particularly to a fuseless breaking switch having an adjusting screw formed at the end of the spring blade which is in connection with a alloy blade, thus by way of the adjusting screw, the arch between the spring blade and the alloy blade can be adjusted to justify different reactions while the current supply is overloaded.

BACKGROUND OF THE INVENTION

Conventional breaking switches usually include fuses, and are generally of complicated structure. A space within the switch must be provided to accommodate the fuse. In earlier types of breaking switches, the fuse was made of zinc. When the switch was overloaded, the fuse would melt. The dripping zinc created the possibility of a short circuit and presented a danger to the user. More recently, a type of fuseless breaking switch has been utilized. Such a switch can be used to protect the circuit from overload, but is not capable of cutting off the power in case of a fire, when it is imperative that the power is interrupted.

As already been taught by the variety publications of the related field about the fuseless breaking switch, one U.S. Pat. No. 5,262,748 is taken into consideration as the most related one to the present invention.

The patent (see FIG. 1 and FIG. 2) mainly is about a fuseless breaking switch comprising a casing 1, a pressure sensitive button 21 mounted at the center of casing 1, and a pair of electrically conductive prongs 3 and 3', wherein, when the button 21 is depressed, it urges rod 23 and consequently the alloy plate 25 downward, and the downward movement of rod 23 will then be held in depressed position by the spring blade 24. Because the alloy plate 25 is fixed in a slot in casing 1, the plate 25 becomes slightly arched when influenced by the downward movement of the rod 23, thus complete the circuit between prongs 3 and 3' and also when the button 21 is released from its depressed position, the rod 23 would again rise to the position where the circuit is open.

Nevertheless, this patent has a problem which it is not able to fit in all kinds of current, voltage supply, especially whenever the circuit is overloaded, the switch will either too easily or hard to cut off the current supply.

SUMMARY OF THE PRESENT INVENTION

It is therefore an object of the present invention to provide a fuseless breaking switch in which the design is simple yet the function effective enough to solve the problems which the prior product can not deal with.

It is another object of the present invention to provide a fuseless breaking switch in which comprises not only the above mentioned apparatus but also an adjusting screw fixed on the end of the spring blade providing adjusting capability to the spring blade in order to have more suitable efficiency applied to deal with all kinds of overloading situations.

The above and other features of the invention, including various details of construction and combination of parts will now be more particularly described with reference to the accompanying drawings, and pointed out in the claims. It will be understood that the particular structure embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the present invention from which its novel features and advantages will be apparent.

DETAILED DESCRIPTION OF THE PRESENT INVENTION

Figure 1:
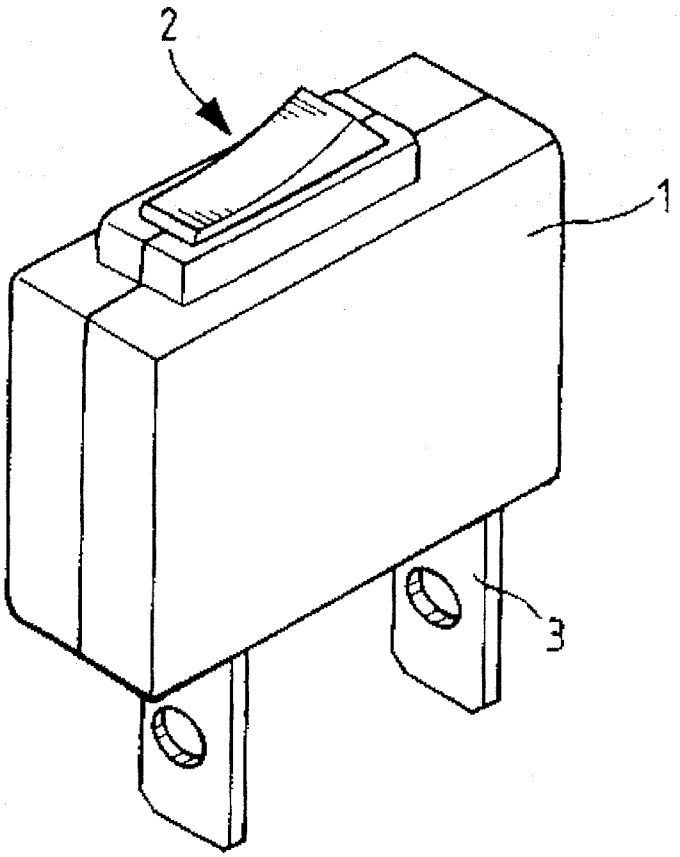
FIG.1 PRIOR ART
FIG. 1 is a perspective view of prior fuseless breaking switch.
Figure 2:
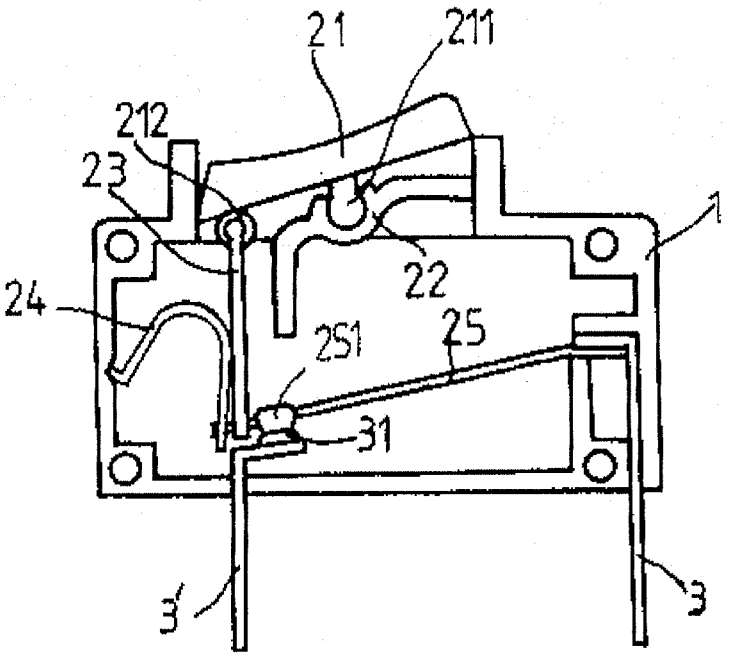
FIG.2 PRIOR ART
FIG. 2 is a cross sectional view of FIG. 1 showing the button in its depressed position and engaging with the prongs thus completing the circuit between the prongs, spring blade and the alloy plate.
Figure 3:
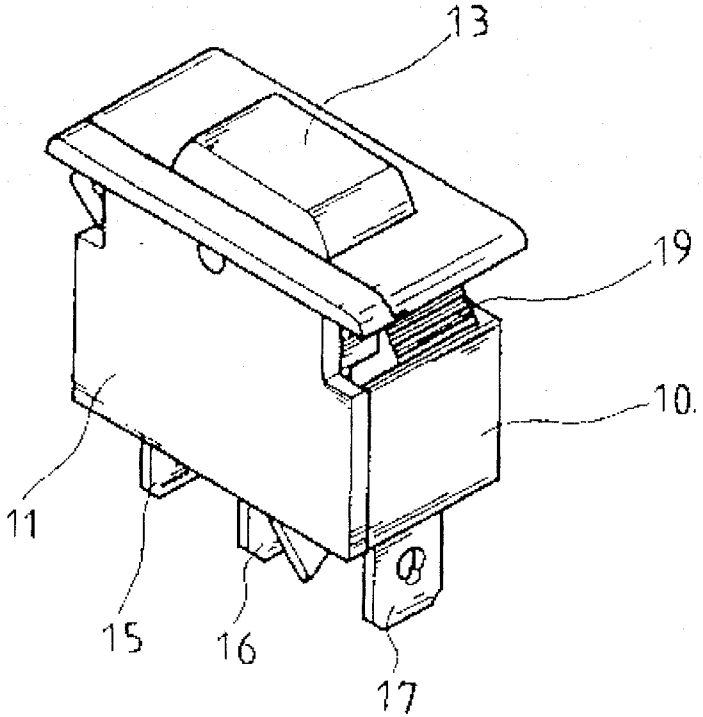
FIG. 3 is a perspective view of the fuseless breaking switch constructed in accordance with the present invention.
Figure 4:
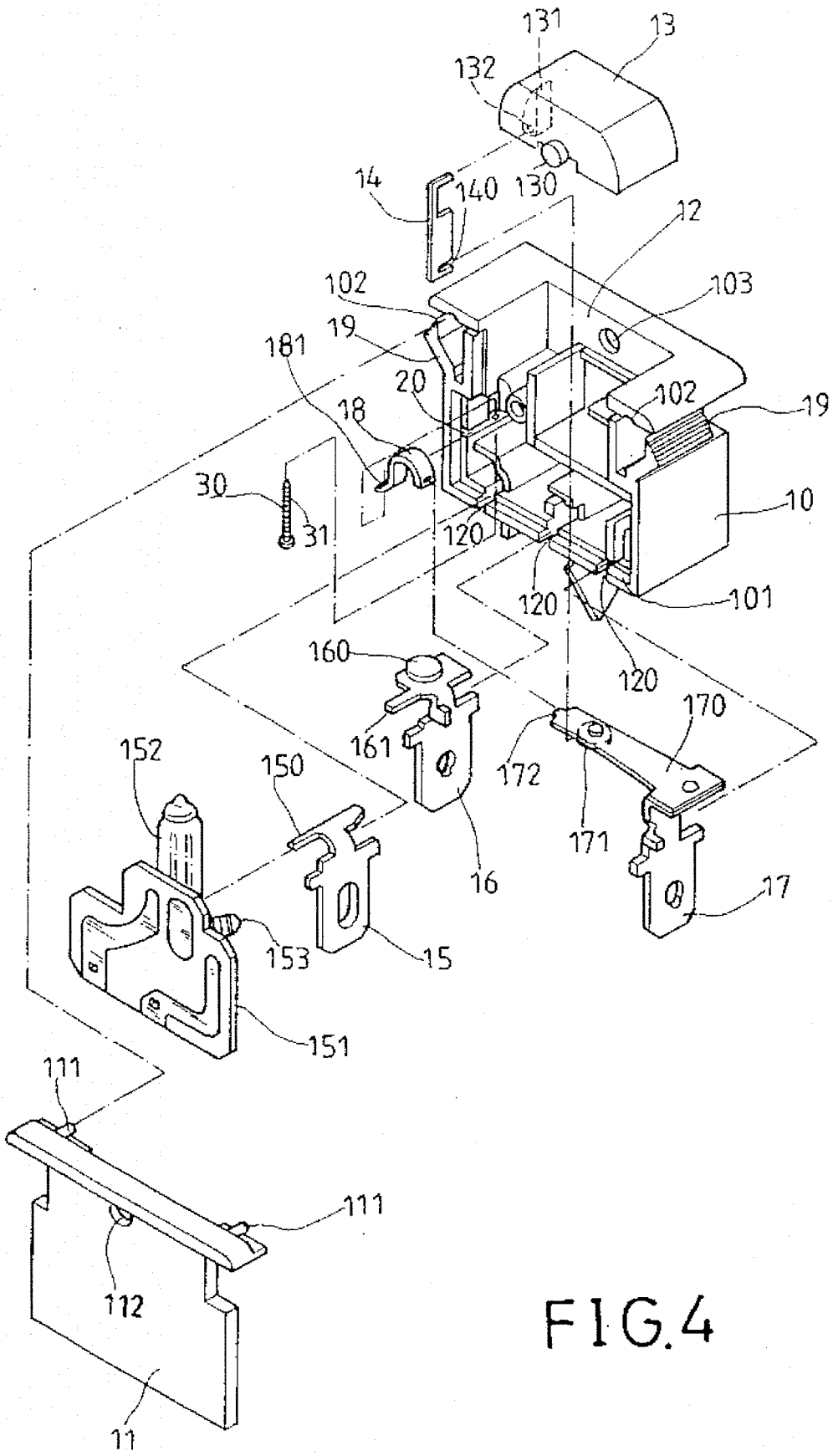
FIG. 4 is an exploded view of the present invention.

Referring to FIG. 3, 4, 5, the present invention comprises a casing 10, a wall 11 mated with recess 12 formed at the upper part of the casing 10 to form the main body of the present invention. The recess 12 in response to the matching with wall 11 has protrudent side 101 and matching hole 102 to mate with pole 111 formed at the ends of the wall 11, respectively. On the wall, a hole 112 is formed corresponding to the hole 103 formed on the side of the recess 12 to receive a button 13 having pivotal projection 130 on the center of both sides, therefore the button 13 is fixed upon the recess 12 by pivotally connection with holes 112, 130 respectively. A protrusion 131 having an extending hole 132 formed therein is formed inside the button 13, the extending hole 132 is then connected to a link 14 having a recess 140 formed at one end.

Three conductive plate 15, 16, 17 are received respectively in three sets of slots 120 formed at the bottom of recess 12, and conductive plates 15 and 16 have individually a projection 150 and 161 connecting to a circuit board 151. A resistor 153 and a neon indicator 152 are set on the circuit board 151, so that the conductive plate 15, 16 can be in series connection with the resistor 153 and the neon indicator 152 to indicate the working status by illuminating the neon indicator 152 when both conductive plate 16, 17 are provided with power.

Figure 5:
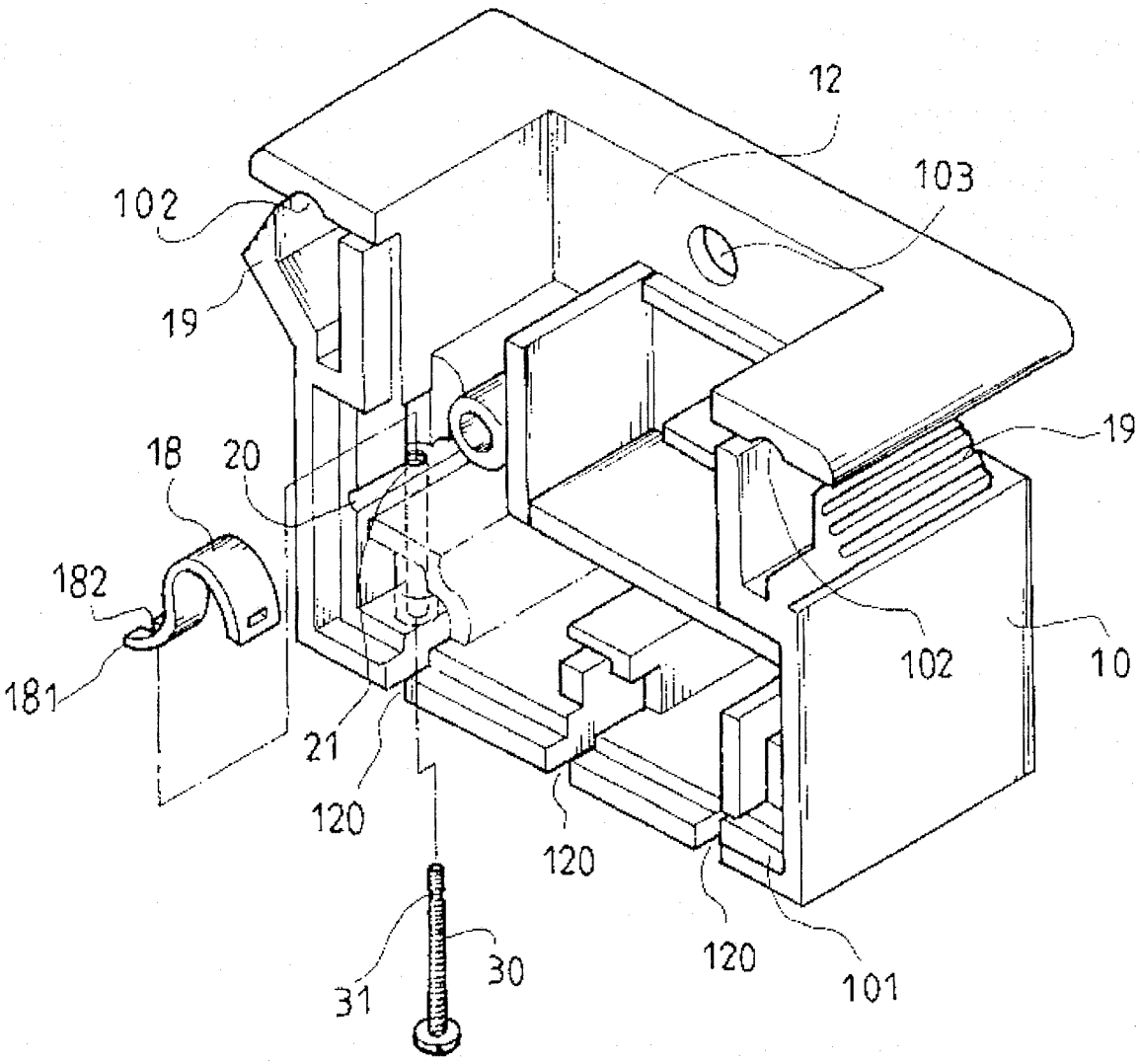
FIG. 5 is a partial enlargement of FIG. 2 showing the detail configuration of the present invention.
Figure 5A:
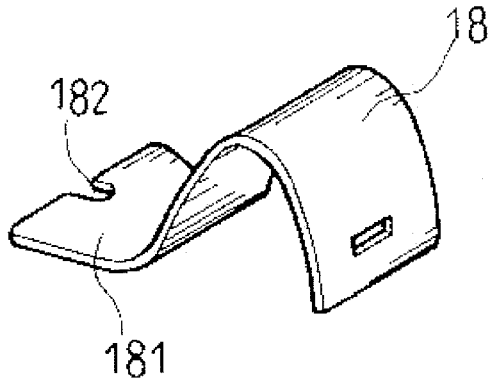
FIG. 5A is another partial enlargement of FIG. 3.
Figure 5A:
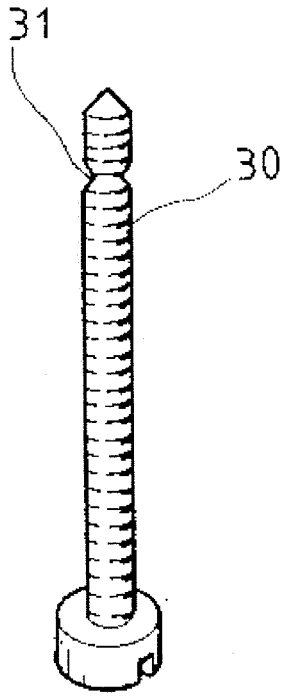

At the top of conductive plate 16, a conduction protrusion 160 is in connection with another conduction protrusion 171 formed at the top of conductive plate 17. Art alloy blade 170 having a feature of changing its curvature when being heated is secured on the conductive plate 17, also, on the far end of the alloy blade 170, a protrusion 172 is connected to one end of a spring blade 18, and another end of spring blade 18 is then seated in the recess 20 formed inside the recess 12; wherein an adjusting screw 30 extending upward from the bottom of the casing 10, through which the concave 31 of the adjusting screw 30 will match with the concave portion 182 of the end 181 of the spring blade 18 (as shown in FIG. 5A), thus making adjusting the angle of spring blade 18 is possible, again, between the conduction protrusion 171 and the protrusion 172 of the alloy blade 170, the button 13, link 14 and the conductive plate 17 form a mechanical connection.

Figure 6:
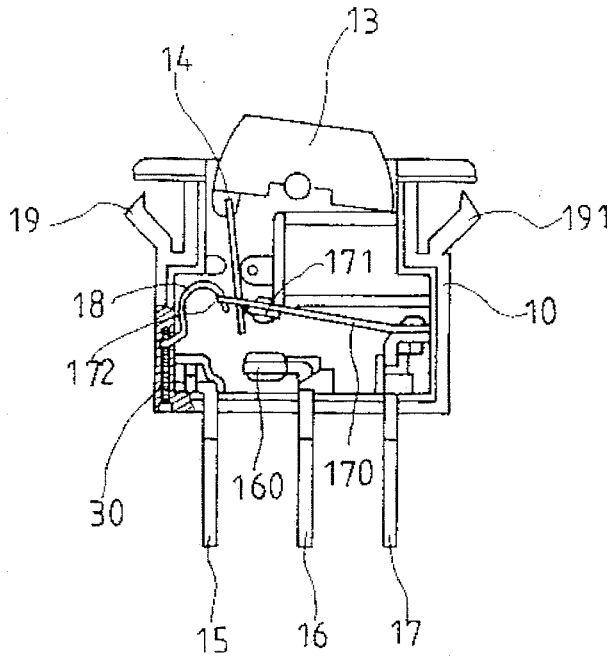
FIG. 6 is a cross sectional view of the present invention showing the internal configuration constructed according to the present invention.
Figure 7:
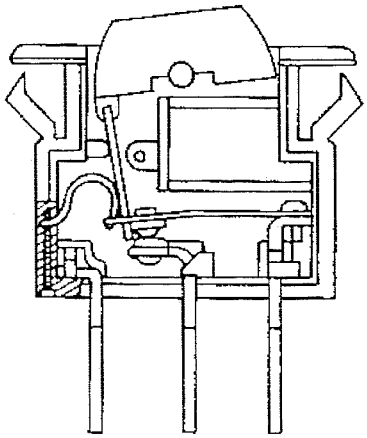
FIG. 7 is another cross sectional view of the present invention showing the button is in its depressed position and thus complete the circuit.

Referring to FIG. 6, when the circuit is open, the alloy blade 170 of the conductive plate 17 and the conduction protrusion 160 of the conductive plate 16 is separate from each other, and form FIG. 7, we can see that when the button 13 is depressed downward, the link 14 will consequently be forced to move downward making the conduction protrusion 171 and the conduction protrusion 160 of the conductive plate 16 to contact with each other and thus completing the conduction. The neon indicator 152 on the circuit board 151 will be lit in response to the conduction between the conduction protrusion 171 and the conduction protrusion 160 to indicate the working status. Yet, when the current between the conductive plate 16 and 17 rises and causes overloading, the alloy blade 170 will change its curvature due to the high temperature. The spring blade 18 will then provide with a recovering force to the alloy blade 170 to overcome the downward force acting thereon, therefore the conduction protrusion 171 is separated from the conduction protrusion 160 of the conductive plate 16 and the circuit is again become open as already shown in FIG. 6. The power is then automatically cut off to avoid danger caused by overloading. As set forth in the previous description of the present invention, a concave portion 182 formed at the end 181 of the spring blade 18 matches with the concave 31 of the adjusting screw 30 to adjust the arch of the spring blade 18 connecting to the alloy blade 170, so that the present invention will increase the reaction sensitivity to different load of voltage and current. This ability to change the arch of the spring blade 18 by means of the adjusting screw 30 is novel and is pertinent to the ones in the art to make various modifications and changes without departing from the spirit and scope of the present invention. Accordingly, the above disclosure should be considered as an illustrative rather than a restrictive sense.

What we claim is:

1. A fuseless breaking switch comprising a casing, a wall, a button, three sets of conductive plates and an adjusting screw characterized in that: the button having pivotal projection on the center of both sides is secured in the holes formed inside the recess of the casing, an extending hole formed therein is connected to a link having a recess formed at one end; three conductive plates seated respectively in three sets of slots formed at the bottom of said recess, the first conductive plate and the second conductive plate each individually has a first projection and second projection connecting to a circuit board, a resistor and a neon indicator are then set thereon, so that the first and second said plates can be in series connection with the resistor and the neon indicator to indicate the working status by illuminating the neon indicator when both first and second conductive plate are provided with power;

at the top of the second conductive plate , a conduction protrusion is in connection with another conduction protrusion formed at the top of the third conductive plate, and an alloy blade having a feature of changing its curvature when being heated is secured on the third conductive plate, also, on the far end of said alloy blade, a protrusion formed thereon is connected to one end of a spring blade, and the other end of said spring blade is then seated and secured in the recess formed inside said casing; wherein an adjusting screw is extending upward from the bottom of the casing, through which the concave of said adjusting screw will match with the concave portion of the end of the spring blade, thus making adjusting the angle of spring blade possible, therefore when the circuit is open, said alloy blade and the conduction protrusion of said second conductive plate is separate from each other, and when the button fixed on the link is depressed downward, the link will consequently be forced to move downward making the conduction protrusion and the conduction protrusion of the second conductive plate to contact with each other, the neon indicator on the circuit board will be lit in response to the conduction between the conduction protrusion of said third conductive plate and the conduction protrusion of said second conductive plate to indicate the working status, yet, when the current between said second and said third conductive plate rises and causes overloading, the alloy blade will change its curvature due to the high temperature, the spring blade will then provide with a recovering force to the alloy blade to overcome the downward force acting thereon, so the conduction protrusion of the third conductive plate is separated from the conduction protrusion of the second conductive plate and the circuit is again become open and the power will then automatically be cut off to avoid danger caused by overloading, and because of the concave portion formed at the end of the spring blade matches with the concave of the adjusting screw, adjusting the arch of the spring blade connecting to the alloy blade is possible.

2. A fuseless breaking switch as claimed in claim 1, wherein three sets of conductive plates extend from the casing and configured such that the switch may be plugged into standard electrical outlet.

3. A fuseless breaking switch as claimed in claim 1, wherein said alloy blade is constructed with heat sensitive material.

* * * * *